US011071363B2

(12) United States Patent
Burko

(10) Patent No.: US 11,071,363 B2
(45) Date of Patent: Jul. 27, 2021

(54) THIN CARD SIZED WALLET

(71) Applicant: Elad Burko, Valley Stream, NY (US)

(72) Inventor: Elad Burko, Valley Stream, NY (US)

( * ) Notice: Subject to any disclaimer, the term of this patent is extended or adjusted under 35 U.S.C. 154(b) by 311 days.

(21) Appl. No.: 16/115,141

(22) Filed: Aug. 28, 2018

(65) Prior Publication Data

US 2020/0069012 A1 Mar. 5, 2020

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01)

(58) Field of Classification Search
CPC .... A45C 1/06; A45C 2001/065; A45C 11/182
USPC ..... 150/131, 132, 147, 136.146; 206/425; 229/75
See application file for complete search history.

(56) References Cited

U.S. PATENT DOCUMENTS 1,821,379 A * 9/1931 Epstein ..... A45C 15/00 150/132
2,586,132 A * 2/1952 Whitmer ..... A45C 1/06 150/133
2,908,306 A 10/1959 Chorost
3,304,979 A 2/1967 Bakken
3,360,027 A 12/1967 Price
3,712,354 A * 1/1973 Lovendale ..... A45C 1/06 150/132
3,903,945 A * 9/1975 Skeba ..... A45C 1/06 150/133
4,194,655 A 3/1980 Tillotson
4,332,338 A 6/1982 Christiansen
4,705,086 A 11/1987 O'Neill
4,782,874 A 11/1988 Chartier
5,103,884 A 4/1992 Roman
5,184,687 A * 2/1993 Abdrakhmanov .... E21B 10/345 175/267
5,257,656 A 11/1993 McLeroy
(Continued)

OTHER PUBLICATIONS

Elad Burko, Card Wallet, https://paperwallet.com/pages/card-wallet. The Card Wallet is a previous wallet design of the present application. The Card Wallet was on-sale greater than one year from the filing date. The present application is with reference to the Micro Wallet, https://paperwallet.com/pages/card-wallet-dc, which has been on-sale less than 1 year from the filing date.

*Primary Examiner* — Sue A Weaver
(74) *Attorney, Agent, or Firm* — Williams Intellectual Property; Timothy Snyder Snyder

(57) ABSTRACT

A thin card sized wallet is provided herein that is super-thin, comfortable to wear, and minimally sized to store and transport essential articles. The thin card sized wallet is formed from a single piece of folded material and includes an obverse face, a reverse face, a pouch, a first sleeve, second sleeve, third sleeve, and fourth sleeve. The pouch is situated between the obverse face and reverse face and is configured to receive articles therein. The first sleeve and second sleeve are situated between the obverse face and the reverse face to receive one or more cards therein. The third sleeve and fourth sleeve are situated on the obverse face to receive one or more cards therein. The wallet may further include radiofrequency identification (RFID) shields to protect RFID enabled cards from electronic theft.

16 Claims, 5 Drawing Sheets

(56) References Cited

U.S. PATENT DOCUMENTS

| | | | | |
|---|---|---|---|---|
| 5,431,207 | A | 7/1995 | Siegel | |
| 5,595,401 | A | 1/1997 | Exline et al. | |
| 6,050,311 | A | 4/2000 | Obenski | |
| 6,923,229 | B2 | 8/2005 | Beckley | |
| 2004/0108032 | A1* | 6/2004 | Lyons | A45C 1/06 150/132 |
| 2007/0096924 | A1 | 5/2007 | Horne | |
| 2009/0021343 | A1 | 1/2009 | Sinha | |
| 2009/0207976 | A1* | 8/2009 | Ito | G06K 19/07327 378/156 |
| 2011/0016615 | A1 | 1/2011 | Massey | |
| 2011/0030860 | A1 | 2/2011 | Allen et al. | |
| 2014/0367005 | A1* | 12/2014 | Delle Vedove | H01L 41/1878 252/62.9 R |
| 2015/0019369 | A1* | 1/2015 | Mills | G06Q 30/0621 705/26.5 |
| 2016/0128437 | A1* | 5/2016 | Burko | A45C 1/06 206/37 |

* cited by examiner

THIN CARD SIZED WALLET

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of pocketsize wallets are known in the prior art. A common problem with many of these wallets is their bulky size, making them uncomfortable to wear. The traditional wallet was designed to store and transport an excessive amount of articles such as receipts, credit cards, business cards, and photographs. However, today in the age of the Internet, smart phones, and digital media, the need for a majority of those articles in hard copy form is outdated. There is now a desire for minimally sized wallets that are super-thin, comfortable to wear, and capable of storing and transporting essential articles (articles deemed essential by the user (e.g., credit cards, driver's license, paper money)).

In addition, electronic theft of data from radiofrequency identification (RFID) enabled credit cards can occur directly from ones wallet, which has become an increasingly prevalent problem. It would be desirous to provide a super-thin wallet capable of combating this problem.

Further, the materials and manufacturing processes for producing many wallets are not ideal from an earth conscious perspective. Ideally, a wallet should be made of a recyclable material, yet durable, water-resistant, and low-cost to produce.

Thus, there exists a need for a thin card sized wallet that is super-thin, comfortable to wear, and minimally sized for storing and transporting essential articles. There is a further need for a thin card sized wallet that protects against electronic theft. There is an even further need for a thin card sized wallet that is earth friendly, durable, water resistant, and low-cost to produce.

FIELD OF THE INVENTION

The present invention relates to pocketsize wallets, and more particularly, to a thin card sized wallet that is super-thin, comfortable to wear, and minimally sized for storing and transporting essential articles.

SUMMARY OF THE INVENTION

The general purpose of the thin card sized wallet, described subsequently in greater detail, is to provide a thin card sized wallet which has many novel features that result in a thin card sized wallet which is not anticipated, rendered obvious, suggested, or even implied by prior art, either alone or in combination thereof.

A thin card sized wallet is described herein. The thin card sized wallet is formed from a single piece of folded material and includes a rectangular obverse face and a corresponding reverse face. A pouch is formed between the obverse face and the reverse face wherein a single open-end of said pouch is positioned at a top edge of the thin card sized wallet. The pouch is configured to receive articles therein. A first sleeve and a second sleeve are likewise formed between the obverse face and the reverse face. A first single open-end of the first sleeve is located at a first side edge of the thin card sized wallet, and a second single open-end of the second sleeve positioned is located an opposing side edge of the thin card sized wallet. The first sleeve and the second sleeve are configured to receive one or more cards therein. The obverse face and the reverse face unitely fold about a vertical axis located between the first side edge and the opposing side edge to form a first obverse face portion and a second obverse face portion. The first obverse face portion is disposed left of the vertical axis on the obverse face, and the second obverse face portion is disposed right of the vertical axis on the obverse face. The first obverse face portion and the second obverse face portion include a third sleeve and a fourth sleeve thereon, respectively. The third sleeve and the fourth sleeve are configured to receive one or more cards therein.

The dimensions of the thin card sized wallet may measure 122±2 millimeters along the horizontal and 88±2 millimeters along the vertical when the thin card sized wallet is in an open state. The average thickness of the thin card sized wallet measures 1.1±0.2 millimeters when the thin card sized wallet is in an open state. Preferably, the single sheet of folded material is made of recycled plastic and more specifically made of high-density polyethylene fibers, commonly referred to as Tyvek®.

The thin card sized wallet may further include a first structural insert positioned inside the first sleeve and a second structural insert positioned inside the second sleeve. The inserts are configured to provide structural support and durability to the wallet for easier handling. The first structural insert and second structural insert may each further include an RFID shield to protect RFID enabled cards in the wallet from electronic theft.

A method of forming the thin card sized wallet is also described herein. The method includes providing a single sheet of material comprising a first rectangular section, a second rectangular section contiguous with the first section, a third rectangular section contiguous with the second section, and a fourth section contiguous with the third section, wherein the first, second, third, and fourth sections are positioned sequentially one after the other. The second section includes a first tab and a second tab disposed on available opposing ends of the second section. The third section includes a third tab and a fourth tab disposed on available opposing ends of the third section. The third section further comprises a cutout in the central region of the third section. The first section is folded on top of the second section to form a first pair of sections. The fourth section is folded on top of the third section to form a second pair of sections. The first pair of sections are folded on top of the second pair of sections such that the cutout remains externally exposed and not hidden by the fold. The third tab and fourth tab are folded into the fold between the first section and the second section. The first tab and the second tab are folded into the fold between the first section and the second section to complete the wallet.

Thus has been broadly outlined the more important features of the present thin card sized wallet so that the detailed description thereof that follows may be better understood and in order that the present contribution to the art may be better appreciated.

Objects of the present thin card sized wallet, along with various novel features that characterize the invention are particularly pointed out in the claims forming a part of this disclosure. For better understanding of the thin card sized wallet, its operating advantages and specific objects attained by its uses, refer to the accompanying drawings and description.

BRIEF DESCRIPTION OF THE DRAWINGS

In the figures, identical structures, element or parts that appear in more than one figure are generally labeled with a same numeral in all the figures in which they appear. Dimensions of components and features shown in the figure are generally chosen for convenience and clarity of presentation and are not necessarily shown to scale. The figures are listed below.

FIGURES

Figure 1:
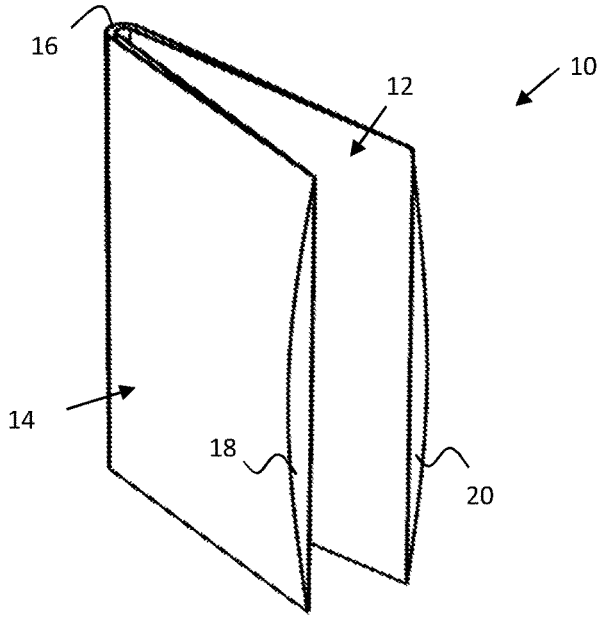

FIG. 1 is a perspective view of the thin card sized wallet in a semi-closed state in accordance with embodiments of the invention.

Figure 2:
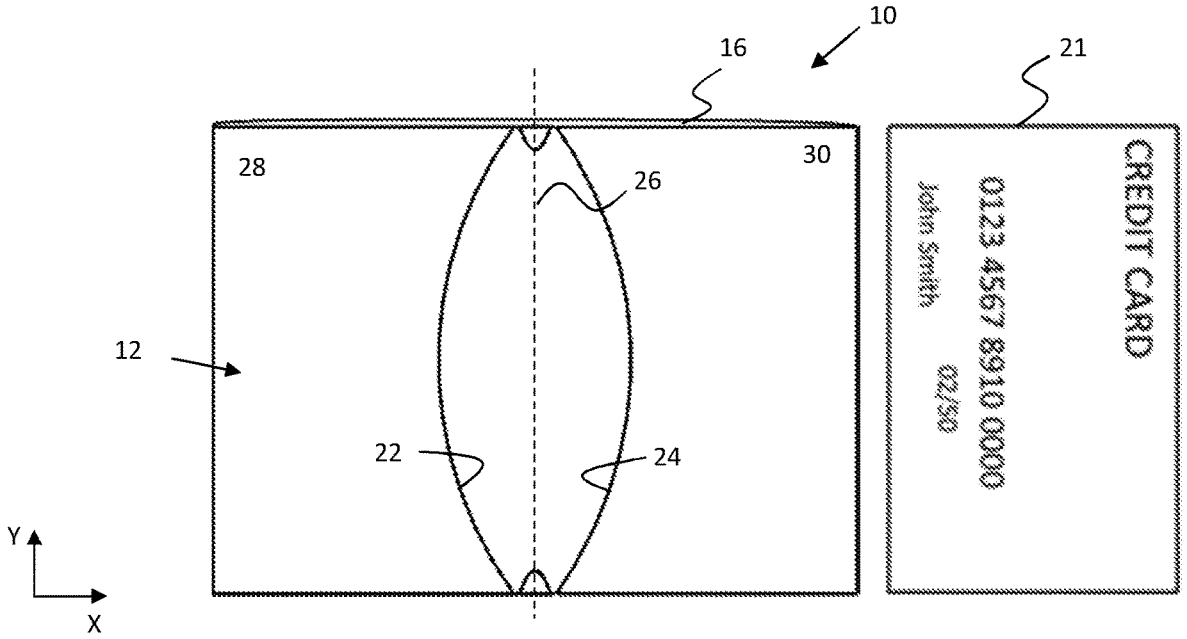

FIG. 2 is a front view of the thin card sized wallet in an open state in accordance with embodiments of the invention.

Figure 3:
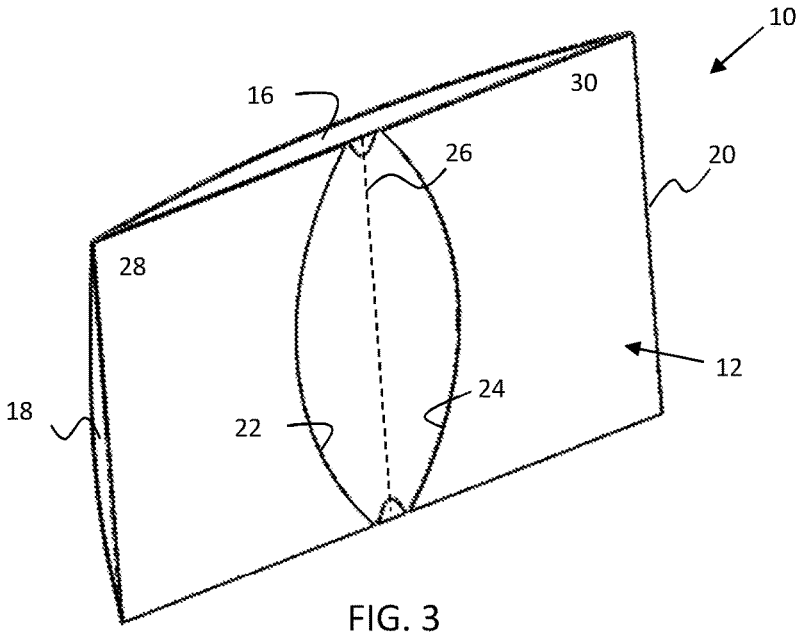

FIG. 3 is a front perspective view of the thin card sized wallet in an open state in accordance with embodiments of the invention.

Figure 4:
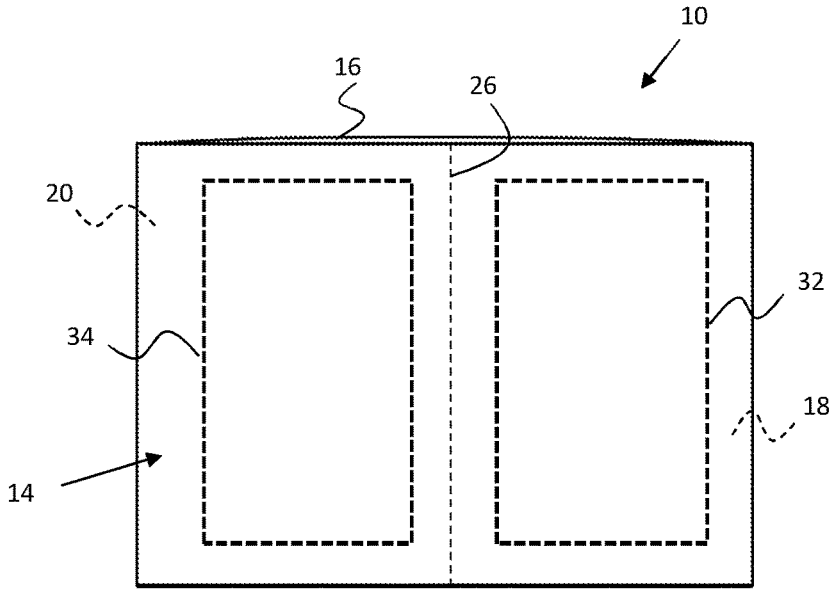

FIG. 4 is a rear view of the thin card sized wallet in an open state in accordance with embodiments of the invention.

Figure 5:
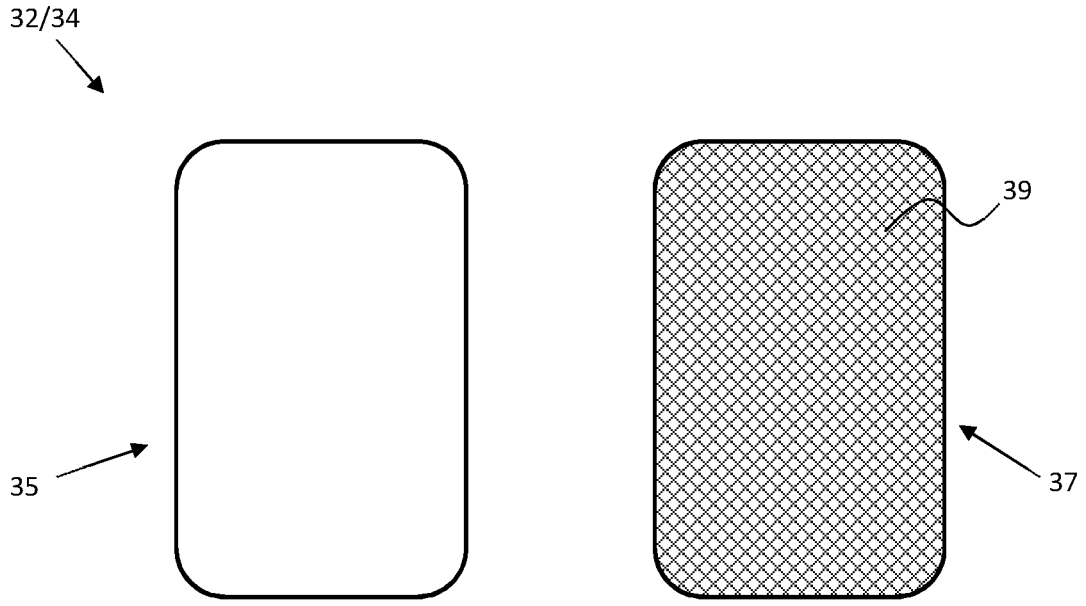

FIG. 5 depicts a structural insert having an RFID shield adhered thereto in accordance with embodiments of the invention.

Figure 6A:
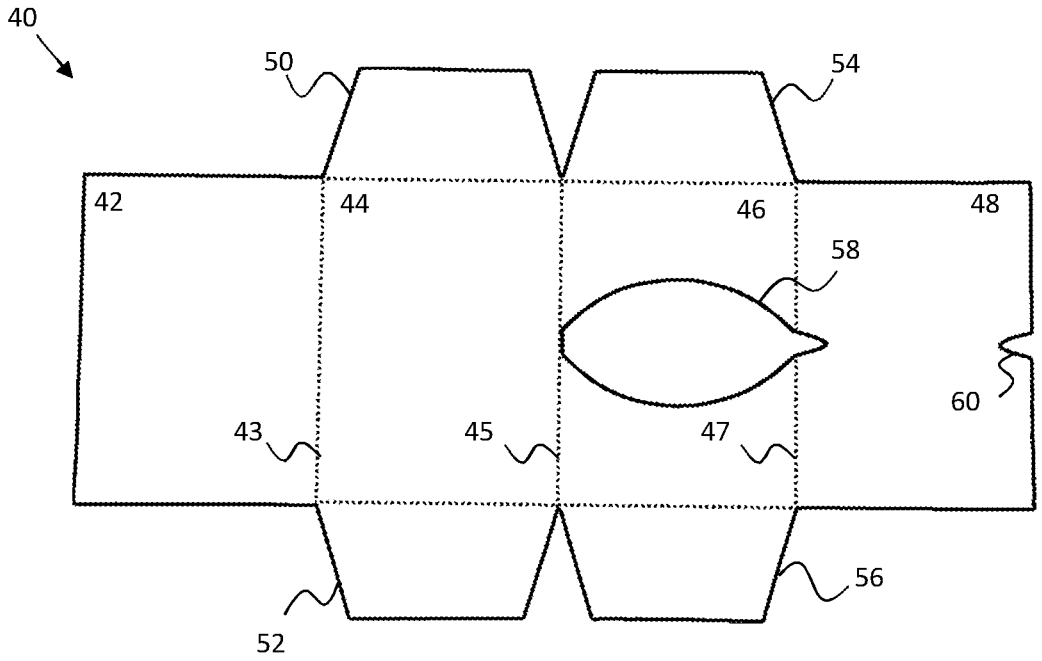

FIG. 6A depicts the configuration of a pre-folded material used to form the thin card sized wallet in accordance with embodiments of the invention.

Figure 6B:
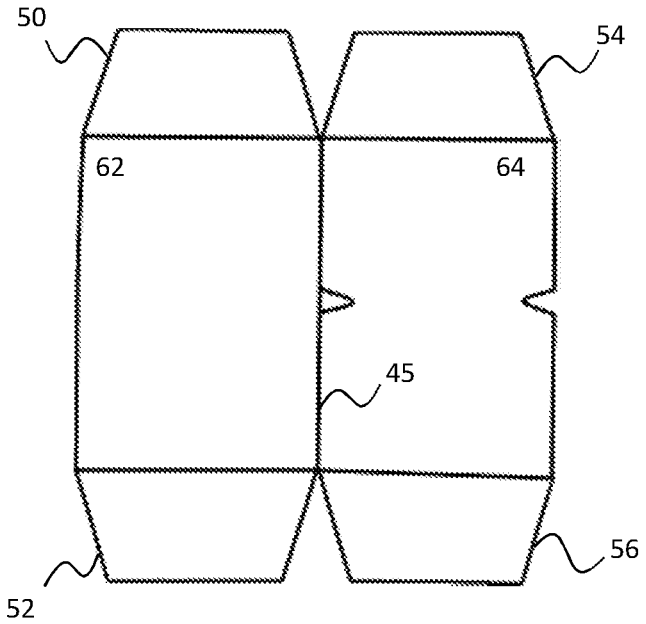

FIG. 6B is a first folding action to form the thin card sized wallet in accordance with embodiments of the invention.

Figure 6C:
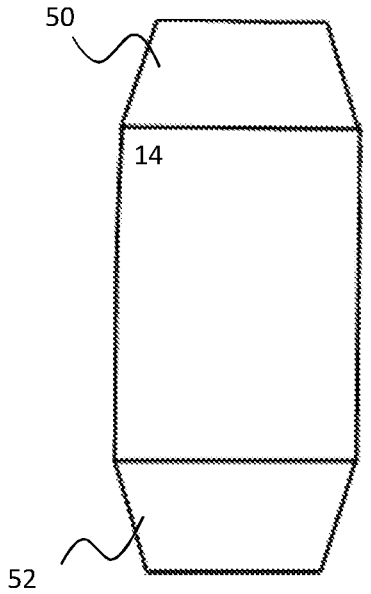

FIG. 6C is a rear view of a second folding action to form the thin card sized wallet in accordance with embodiments of the invention.

Figure 6D:
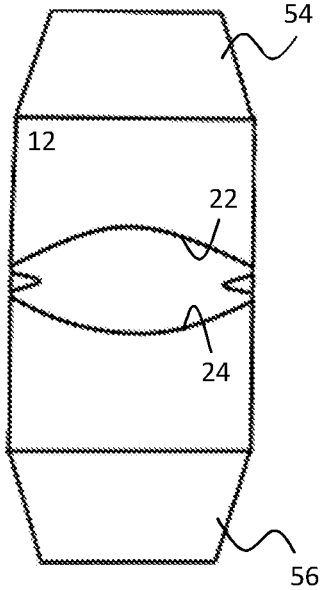

FIG. 6D is a front view of the second folding action to form the thin card sized wallet in accordance with embodiments of the invention.

Figure 6E:
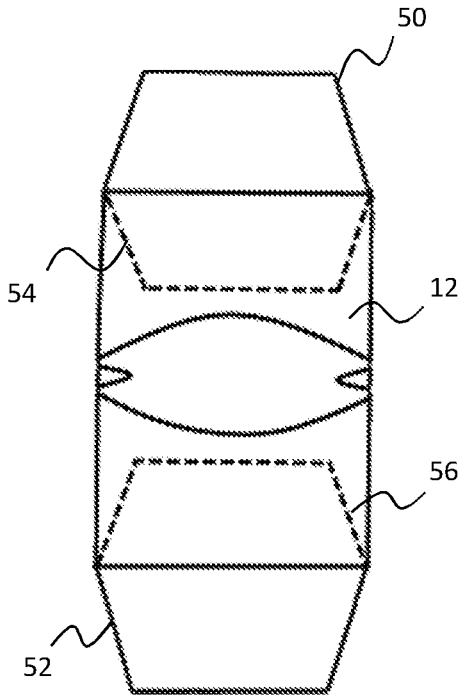

FIG. 6E is a front view of a third folding action to form the thin card sized wallet in accordance with embodiments of the invention.

Figure 6F:
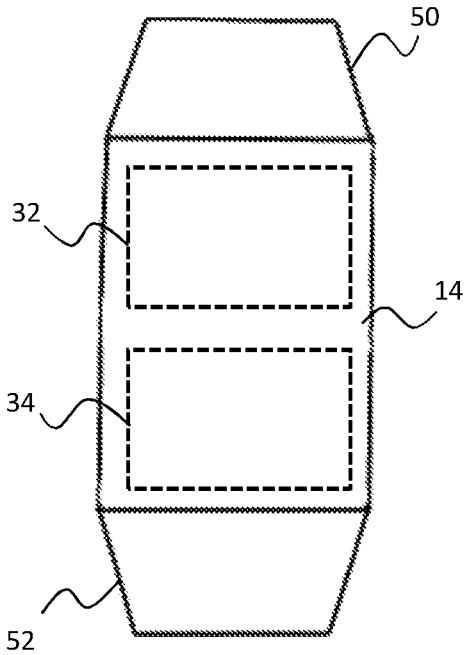

FIG. 6F is a rear view of inserting RFID shields into the thin card sized wallet in accordance with embodiments of the invention.

Figure 6G:
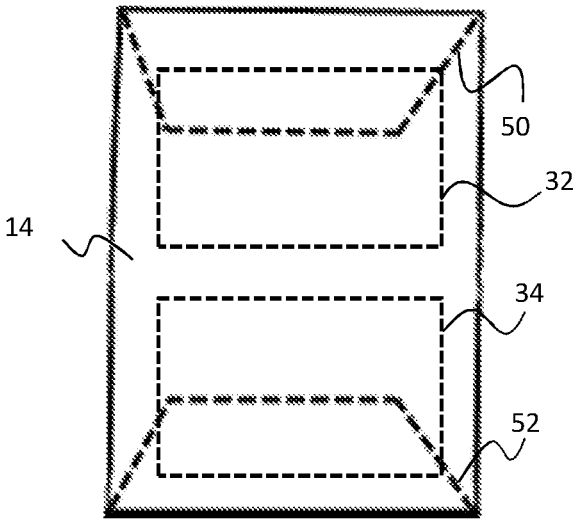

FIG. 6G is a rear view of a fourth folding action to form the thin card sized wallet in accordance with embodiments of the invention.

DETAILED DESCRIPTION OF THE DRAWINGS

The present invention has utility as a thin card sized wallet that is super-thin, comfortable to wear, and minimally sized for storing and transporting essential articles. In some embodiments, the thin card sized wallet is further made of a minimal amount of recyclable material yet durable, water resistance, and produce cost effectively. In other embodiments the thin card sized wallet further protects against electronic theft. In preferred embodiments, the thin card sized wallet is sized to be as small as possible for storing and transporting standard sized credit cards. The following description of various embodiments of the invention is not intended to limit the invention to those specific embodiments, but rather to enable any person skilled in the art to make and use this invention through exemplary aspects thereof.

It is to be understood that in instances where a range of values are provided, or a ± deviation, that the range/deviation is intended to encompass not only the end point values of the range but also intermediate values of the range as explicitly being included within the range and varying by the last significant figure of that range. By way of example, a recited range of 1 to 4 is intended to include 1-2, 1-3, 2-4, 3-4, and 1-4. Likewise, a recited deviation of 1.0±0.5 is intended to include 0.5-1.5, 0.5-1, and 1-1.5.

As used herein for directional convention, the horizontal direction refers to the X-direction and the vertical direction refers to the Y-direction with respect to the thin card sized wallet as shown in FIG. 2.

With reference now to the drawings, and in particular FIGS. 1 through 6G thereof, example of the instant thin card sized wallet employing the principles and concepts of the present thin card sized wallet and generally designated by the reference number 10 will be described.

Referring now particularly to FIGS. 1 through 4 a preferred embodiment of the present thin card sized wallet 10 is illustrated, where FIG. 1 depicts the thin card sized wallet 10 in a semi-closed state, FIG. 2 depicts a front view of the thin card sized wallet in an open state, FIG. 3 depicts a front perspective view of the thin card sized wallet 10 in an open state, and FIG. 4 depicts a rear view of the thin card sized wallet 10 in an open state. The thin card sized wallet 10 is formed from a single sheet of folded material. The thin card sized wallet 10 generally includes a rectangular obverse face 12, a corresponding reverse face 14, a pouch 16, a first sleeve 18, a second sleeve 20, a third sleeve 22, and a fourth sleeve 24, all of which will be described in more detail below.

The obverse face 12 corresponds to the reverse face 14 in that dimensions of the two are substantially the same (less than a 2 millimeter (mm) difference along the horizontal or vertical), if not identical. The obverse face 12 and reverse face 14 may also be considered an inner face and outer face of a wallet, respectively. The obverse face 12 and reverse face 14 make up the horizontal and vertical dimensions of the thin card sized wallet 10 and since the faces (12, 14) are rectangular, the thin card sized wallet 10 has a top edge, a bottom edge, and two opposing side edges.

The pouch 16 is formed between the obverse face 12 and the reverse face 14. The pouch 16 is pocketlike having a single open-end that resides along the top edge of the thin card sized wallet 10, and three closed-ends located on a first side edge, an opposing side edge, and the bottom edge of the wallet 10 creating an interior portion of the wallet 10 between the obverse face 12 and reverse face 14. The interior portion of the pouch 16 is continuous along the vertical and horizontal of the wallet 10 having dimensions greater than 50% of the vertical and horizontal dimensions of the wallet 10. The pouch 16 may therefore receive articles therein such as paper money, receipts, photos, and any other articles the user desires to store and transport. It should be appreciated, that the closed-ends described herein doesn't necessarily refer to a continuously closed-end, rather the closed-ends may have holes or other openings therein. Such closed-ends are still capable of restraining larger contents thereagainst (contents that are larger than the holes or openings).

The first sleeve 18 and the second sleeve 20 are also formed between the obverse face 12 and the reverse face 14. More specifically, the first sleeve 18 and second sleeve 20 are situated between an inner surface of the pouch 16 and the reverse face 14. The first sleeve 18 and second sleeve 20 are also pocketlike having a first single open-end and a second single open-end, respectively. The first single open-end is positioned at a first side edge of the thin card sized wallet 10, and the second single open-end is positioned at the opposing side edge of the wallet 10. In a particular embodiment, the first sleeve 18 and the second sleeve 20 are connected therein to form a single sleeve connecting the first single open-end and the second single open-end. In other words, the inner portions of the 'pockets' of the first sleeve 18 and the second sleeve 20 are continuous therethrough to form one long sleeve having two open-ends positioned on opposing side edges of the wallet 10 and two closed-ends positioned on a top edge and bottom edge of the wallet 10. However, the first sleeve 18 and second sleeve 20 are still distinct and delineated by a vertical axis 26 located between the first side edge and an opposing side edge of the wallet 10, in which the obverse face 12 and reverse face 14 unitely fold about to open and close the wallet 10. The first sleeve 18 and second sleeve 20 are configured to receive one or more cards therein (e.g., credit cards, driver's license, and business cards). In specific embodiments, the first sleeve 18 and second sleeve 20 are formed with a size to fit at least one standard credit card 21, the dimensions of which are approximately 85.6 mm wide and 53.90 mm high, where the cards are stored in the sleeves (18, 20) with the width of card aligned along the vertical of the wallet 10. In a further embodiment, the first sleeve 18 and second sleeve 20 can fit two cards therein based on an expandability of the material of the wallet 10 and the origami design of the wallet 10. The wallet 10 was designed with a particular template 40 and origami fold as shown and described with reference to FIGS. 6A-6G wherein a standard credit card fits in the sleeves with a clearance of less than 1.0 millimeters, less than 0.5 millimeters, and in a further embodiment, less than 0.1 millimeters. Additionally, this particular template 40 and origami fold were invented to permit a degree of expandability beyond the elasticity of the material of the wallet 10 to allow up to two standard credit cards per sleeve. Therefore, the thin card sized wallet 10 is designed to be as small as possible for storing and transporting up to 8 total standard credit cards.

As briefly described above, the obverse face 12 and reverse face 14 unitely fold along a shared vertical axis 26 located between the first side edge and the opposing side edge to open and close the wallet. In a particular embodiment, the vertical axis 26 is located midway between the first side edge and the opposing side edge. The vertical axis 26 engenders a first obverse face portion 28 and a second obverse face portion 30. The first obverse face portion 28 is disposed left of the vertical axis 26 on the obverse face 12, and the second obverse face portion 30 is disposed right of the vertical axis 26 on the obverse face 12. The third sleeve 22 and fourth sleeve 24 are formed on and/or integrated with the first obverse face portion 28 and the second obverse face portion 30, respectively. The third sleeve 22 and fourth sleeve 24 are also pocketlike. The third sleeve 22 having a third single open-end positioned vertically and proximal to the vertical axis 26 on the first obverse face portion 28, and the fourth sleeve 24 having a fourth single open-end positioned vertically and proximal to the vertical axis 26 on the second obverse face portion 30. The third sleeve 22 and fourth sleeve 24 each have three closed-ends located along a portion of the top edge, their corresponding side edge, and a portion of the bottom edge of the wallet 10. In a particular embodiment, the third sleeve mirrors the fourth sleeve about the vertical axis 26. In a particular embodiment, the shape of the third open-end and fourth open end are arcuate to facilitate the insertion and retrieval of a card therein, but it should be appreciated that other shapes of open-ends are feasible such as a straight, triangular, or wavy shape. In specific embodiments, the third sleeve 22 and fourth sleeve 24 are formed with a size to fit at least one standard credit card, wherein the cards are stored in the sleeves (22, 24) with the width of the card aligned along the vertical of the wallet 10. In a further embodiment, the third sleeve 22 and fourth sleeve 24 can fit two cards therein based on an expandability of the material of the wallet 10. If the sleeves (18, 20, 22, 24) of the wallet 10 can each fit two cards, then the total card carrying capacity of the wallet 10 is at least 8 cards.

In a particular embodiment the dimension of the thin card sized wallet 10 is 122±2 millimeters (mm) along the horizontal and 88±2 mm along the vertical when the thin card sized wallet 10 is in the open state. The thickness of the wallet 10 measures about 0.3 mm thicker than a standard credit card when the wallet 10 is in an open state. A standard credit card has a thickness of about 0.76 mm and therefore, in some embodiments, the average thickness of the wallet 10 is 1.1±0.2 mm when the wallet is in an open state. In a particular embodiment, the thickness of the wallet 10 in an open state measures between 0.9 mm and 1.3 mm depending on where a user acquires the measurement on the wallet 10. In other embodiments, the thickness measures between 1.0 mm and 1.2 mm for an average thickness of 1.0±0.1 mm.

In a specific inventive embodiment, the single sheet of folded material that forms the wallet 10 is a polymeric material, and more preferably a recycled polymeric material. In a particular inventive embodiment, the polymeric material is high-density polyethylene fibers known as Tyvek®, and more specifically Tyvek 1073D. Tyvek is particularly advantageous because the material is recyclable, durable, and water resistant. The material can also be produced in very thin sheets and easily folded to form a super-thin wallet 10.

In a specific inventive embodiment, with reference to FIG. 4, the thin card sized wallet 10 further includes a first structural insert 32 positioned inside the first sleeve 18 and a second structural insert 34 positioned inside the second sleeve 20. The structural inserts (32, 34) are particularly advantageous to improve the rigidity and durability of the wallet 10 for easier handling. In some embodiments, the structural inserts (32, 34) are constructed of a semi-rigid polymeric material. In particular embodiments, the structural inserts are preferably made of polyethylene terephthalate (PET). The structural inserts may have the same vertical and horizontal dimensions of a standard credit (e.g., approximately 85.6 mm along the horizontal and 53.90 mm along the vertical). The thickness of the structural inserts (32, 34) is between 0.15±0.10 mm and 0.55±0.10 mm such that the average thickness of the wallet 10 is no larger than 1.1±0.2 millimeters while in an open state when the structural inserts (32, 34) are positioned therein. Further, the corners of the structural inserts (32, 34) are advantageously rounded, as pointed edges were shown to puncture or tear through the material of the wallet 10. With reference to FIG. 5, a structural insert (32, 34) is shown, where each structural insert (32, 34) includes an obverse surface 35 and a reverse surface 37. In particular inventive embodiments, an RFID shield 39 is adhered to the reverse surface 37 of each structural insert (32, 34). The RFID shields 39 are configured to protect against electronic theft of RFID-enabled cards stored in the thin card sized wallet 10. The RFID shields 39 are preferably made of a copper-nickel alloy mesh, although other materials known in the art are possible. The RFID shields may be in rectangular form having a height and width of a standard credit card and may match the dimensions of the structural inserts (32, 34). The RFID shields 39 may further have rounded corners like the structural inserts (32, 34) for the reasons described above. In order to protect all of the cards stored in the wallet 10 against electronic theft, the structural inserts (32, 34) with the adhered RFID shields 39 are preferably positioned at a most rear position inside the sleeves (18, 20), the most rear position being towards the reverse face 14 inside the sleeves (18, 20). Therefore, any cards stored in the first sleeve 18, second sleeve 20, third sleeve 22, and/or fourth sleeve 24 are covered by the shields 39 and protected from electronic theft when the wallet 10 is closed.

With reference now to FIGS. 6A through 6G, a single sheet of pre-folded material 40 used to form the wallet 10 is shown, which will now be described in conjunction with a method of forming the wallet 10. The pre-folded material 40 includes a first rectangular section 42, a second rectangular section 44 contiguous with the first section 42 and forming a first border 43 therebetween, a third rectangular section 46 contiguous with the second section 44 and forming a second border 45 therebetween, and a fourth section 48 contiguous with the third section 46 and forming a third border 47 therebetween. The first 42, second 44, third 46, and fourth sections 48 are positioned sequentially one after the other to form one single rectangular section. The second section 44 includes a first tab 50 and a second tab 52 disposed on the available opposing ends of the second section 44. The third section 46, likewise, includes a third tab 54 and a fourth tab 56 disposed on the available opposing ends of the third section 46. The first tab 50, second tab 52, third tab 54, and fourth tab 56 are preferably in the shape of an isosceles trapezoid for easy handling. The third section 46 further comprises a cutout 58 in the central region of the third section 46. The cutout 58 will provide the third and fourth open-end and access into the third sleeve 22 and the fourth sleeve 24 when the single sheet of material is folded. In specific embodiments, the cutout 58 is in the shape of an ellipse having a central axis aligned with a longitudinal axis formed the first, second, third, and fourth sections. The ellipse further has a blunt end at the second border 45 and an arced end extending slightly beyond the third border 47. The fourth section 48 may further include an arced notch 60 at a side edge of the fourth section 48 that mirrors the arced end of the ellipse about a central axis of the fourth section 48. The arced end and arced notch 60 may aid in handling and improve the flexibility of the wallet 10.

To form the wallet 10 with the pre-folded material 40, the first section 42 is folded on top of the second section 44 about the first border 43 to form a first pair of sections 62 as shown. Likewise, the fourth section 48 is folded on top of the third section 46 about the third border 47 to form a second pair of sections 64. The first pair and second pair of sections (62, 64) are shown in FIG. 5B. Next, the first pair of sections 62 is folded on top of the second pair of sections 64 such that the cutout 58 is externally exposed and not hidden by this fold. After this fold, the obverse face 12, reverse face 14, third sleeve 22, and fourth sleeve 24 of the wallet 10 become apparent as shown in FIG. 5C (rear view) and FIG. 5D (front view). Subsequently, the third tab 54 and fourth tab 56 are folded into the fold between the first section 42 and the second section 44 as shown in FIG. 5E, which completes the pouch 16 and forms the first sleeve 18 and second sleeve 20. The structural inserts (32, 34) are then placed inside the first sleeve 18 and second sleeve 20 as shown in FIG. 5F. The first tab 50 and second tab 52 are then folded into the first sleeve 18 and second sleeve 20 (which is also the fold formed between the first section 42 and second section 44) and on top of the structural inserts (32, 34) to secure the structural inserts (32, 34) therein as shown in FIG. 5G. In particular embodiments, an adhesive is used between the obverse surfaces 35 of the structural inserts (32, 34) and the first tab 50 and second tab 52, respectively, to secure the structural inserts (32, 34) therein. In a further embodiment, adhesive may be used to secure the third tab 54 and the fourth tab 56 to the first section 42 inside the first sleeve 18 and second sleeve 20. The use of adhesive is particularly advantageous for a wallet 10 created by an origami fold, as a wallet 10 without said adhesive may easily fall apart during use. Finally, a fold is created to form the vertical axis 26 to complete the thin card sized wallet 10.

Other Embodiments

While at least one exemplary embodiment has been presented in the foregoing detail description, it should be appreciated that a vast number of variations exist. It should also be appreciated that the exemplary embodiment or exemplary embodiments are only examples, and are not intended to limit the scope, applicability, or configuration of the described embodiments in any way. It should be understood that various changes may be made in the function and arrangement of elements without departing from the scope as set forth in the appended claims and the legal equivalents thereof.

What is claimed is:

1. A thin card sized wallet comprising:

a rectangular obverse face and a corresponding reverse face, wherein said obverse face and said reverse face unitely fold about a vertical axis located between a first side edge and an opposing side edge of the thin card sized wallet;

a pouch configured to receive articles therein, said pouch formed between the obverse face and the reverse face wherein said pouch comprises a single open-end positioned at a top edge of the thin card sized wallet;

a first sleeve and a second sleeve formed between the obverse face and the reverse face, said first sleeve comprising a first single open-end located at the first side edge of the thin card sized wallet, said second sleeve comprising a second single open-end located at the opposing side edge of the thin card sized wallet, and wherein said first sleeve and said second sleeve are configured to receive one or more cards therein;

a first structural insert positioned inside the first sleeve and a second structural insert positioned inside the second sleeve, wherein the first structural insert and second structural insert are semi-rigid to provide structural support to the wallet;

wherein said obverse face and said reverse face unitely fold about the vertical axis located between the first side edge and the opposing side edge to form a first obverse face portion and a second obverse face portions, said first obverse face portion disposed left of the vertical axis on the obverse face and said second obverse face portion disposed right of the vertical axis on the obverse face;

wherein said first obverse face portion and said second obverse face portion comprise a third sleeve and a fourth sleeve thereon, respectively, said third sleeve and said fourth sleeve are configured to receive one or more cards therein; and wherein the obverse face, the reverse face, the pouch, the first sleeve, the second sleeve, the third sleeve, and the fourth sleeve are all formed from a single sheet of folded material made of high-density polyethylene fibers.

2. The thin card sized wallet of claim 1 further comprising a first radiofrequency identification (RFID) shield adhered to a reverse surface of the first structural insert and a second RFID shield adhered to a reverse surface of the second structural insert, said first shield and second shield configured to protect against electronic theft of RFID-enabled cards stored in the thin card sized wallet.

3. The thin card sized wallet of claim 2 wherein the first RFID shield and the second RFID shield are made of a copper-nickel alloy mesh.

4. The thin card sized wallet of claim 1 wherein the first sleeve and the second sleeve are connected therein to form a single sleeve connecting the first single open-end and the second single open-end.

5. The thin card sized wallet of claim 1 wherein the third sleeve comprises a third single open-end positioned vertically and proximal to the vertical axis on the first obverse face portion, and the fourth sleeve comprises a fourth single open-end positioned vertically and proximal to the vertical axis on the second obverse face portion.

6. The thin card sized wallet of claim 5 wherein the single sheet of folded material in a pre-folded state comprises a first rectangular section, a second rectangular section contiguous with the first section, a third rectangular section contiguous with the second section, and a fourth section contiguous with the third section, wherein the first, second, third, and fourth sections are positioned sequentially one after the other, said second section having a first tab and a second tab, said first tab and second tab disposed on opposing ends of the second section, said third section having a third tab and a fourth tab, said third tab and said fourth tab disposed on opposing ends of the third section, and wherein said third section further comprises a cutout in the central region of the third section, said cutout providing the third single open-end and the fourth single open end when the single sheet of material is folded.

7. The thin card sized wallet of claim 6 wherein the first section is folded on top of the second section to form a first pair of sections, the fourth section is folded on top of the third section to form a second pair of sections, the first pair of sections is folded on top of the second pair of sections such that the cutout remains externally exposed, the third tab and fourth tab are folded into the fold between the first section and the second section to complete the pouch, and the first tab and the second tab are folded into the fold between the first section and the second section to fully form the thin card sized wallet.

8. The thin card sized wallet of claim 6 wherein the cutout is in the form of an ellipse.

9. The thin card sized wallet of claim 8 further comprising adhesive disposed on the third tab and the fourth tab to secure the third tab and fourth tab into the fold between the first section and the second section.

10. The thin card sized wallet of claim 6 further comprising a first radiofrequency identification (RFID) shield adhered to a reverse surface of the first structural insert and a second RFID shield adhered to a reverse surfaced of the second structural insert, said first shield and second shield configured to protect RFID-enabled cards stored in the thin card sized wallet, and wherein the structural insert is secured inside the first sleeve by the first tab of the second section, and the second structural insert is secured inside the second sleeve by the second tab of the second section.

11. The thin card sized wallet of claim 10 wherein the first structural insert is further secured with an adhesive between the first tab and an obverse surface of the first structural insert, and the second structural insert is further secured with an adhesive between the second tab and an obverse surface of the second structural insert.

12. The thin card sized wallet of claim 1 wherein the first sleeve, second sleeve, third sleeve, and fourth sleeve are each sized to fit at least one standard credit card, and expandable enough to permit each of the first sleeve, second sleeve, third sleeve, and fourth sleeve each to fit two standard credit cards, for a total carrying capacity of eight standard credit cards.

13. The thin card sized wallet of claim 1 wherein the dimensions of the thin card sized wallet in an open state measures 122±2 millimeters along the horizontal, 88±2 millimeters along the vertical, with an average thickness of 1.1±0.2 millimeters.

14. A method of forming the thin card sized wallet of claim 1 comprising:

providing the single sheet of material comprising a first rectangular section, a second rectangular section contiguous with the first section, a third rectangular section contiguous with the second section, and a fourth section contiguous with the third section, wherein the first, second, third, and fourth sections are positioned sequentially one after the other, said second section having a first tab and a second tab disposed on available opposing ends of the second section, said third section having a third tab and a fourth tab disposed on available opposing ends of the third section, and wherein said third section further comprises a cutout in the central region of the third section;

folding the first section on top of the second section to form a first pair of sections;

folding the fourth section on top of the third section to form a second pair of sections;

folding the first pair of sections on top of the second pair of sections such that the cutout remains externally exposed;

folding the third tab and fourth tab into the fold between the first section and the second section; and folding the first tab and the second tab into the fold between the first section and the second section.

15. The method of claim 14 further comprising:

providing the first structural insert and the second structural insert;

inserting the first structural insert and the second structural insert into opposing ends of the space formed by the fold between the first section and the second section;

folding the first tab and the second tab into the fold between the first section and the second section and on top of the first structural insert and second structural insert, respectively, to secure the first and second structural inserts therein.

16. The method of claim 14 further comprising:

depositing adhesive on at least one of the first structural insert, the second structural insert, the first tab, or the second tab prior to folding the first tab and the second tab into the fold between the first section and the second section.

* * * * *